United States Patent [19]

Klemm et al.

[11] Patent Number: 4,796,814

[45] Date of Patent: Jan. 10, 1989

[54] SEMI-LIQUID CEMENTITIOUS SPRAY NOZZLE APPARATUS

[75] Inventors: Robert E. Klemm, Milwaukee; Gary D. Lehnhardt, Belgium, both of Wis.

[73] Assignee: Construction Forms, Inc., Cedarburg, Wis.

[21] Appl. No.: 94,651

[22] Filed: Sep. 9, 1987

[51] Int. Cl.[4] ..... B05B 7/04; B05B 7/14

[52] U.S. Cl. ..... 239/430; 239/433

[58] Field of Search ..... 239/423, 424, 424.5, 239/429, 430, 433, 434, 431

[56] References Cited

U.S. PATENT DOCUMENTS

| | | | |
|---|---|---|---|
| 2,965,312 | 12/1960 | Hale | 239/430 X |
| 4,411,389 | 10/1983 | Harrison | 239/430 X |

FOREIGN PATENT DOCUMENTS

| | | | |
|---|---|---|---|
| 830898 | 2/1952 | Fed. Rep. of Germany | 239/429 |
| 1477956 | 4/1969 | Fed. Rep. of Germany | 239/434 |
| 3012712 | 10/1981 | Fed. Rep. of Germany | 239/434 |
| 1376164 | 12/1974 | United Kingdom | 239/430 |

OTHER PUBLICATIONS

Article entitled: "Shotecrete Shoots Into Concrete Construction Mainstream" from Concrete Pumping, Nov./Dec., pp. 16–17, 20–22.

Article entitled: "Dry- and wet-mix process shotecrete" from Concrete Construction, Jul., 1984, pp. 629–630.

*Primary Examiner*—Andres Kashnikow
*Assistant Examiner*—Mary Beth O. Jones
*Attorney, Agent, or Firm*—Andrus, Sceales, Starke & Sawall

[57] ABSTRACT

A semi-liquid cementitious pump nozzle unit for pumping cement, concrete, grout and other abrasive materials includes an air chamber assembly having an outer integral swivel housing. A tubular steel body has a threaded coupling for connection to a pump hose. An air chamber recess extends about the nozzle body with transfer openings located centrally of the recess. An outer air housing in a form of a simple tubular member is telescoped over the end walls and sealed thereto by O-ring seals. The opposite ends of the housing are smooth bearing surfaces. Annular bearing walls project radially outwardly by the nozzle and abutting the bearing surfaces of the housing. The bearing walls may be snap ring units releasably applied to the nozzle body. A nozzle reducer secured to the end of the nozzle body may have an appropriate end directly abutting the air/-swivel housing to form a bearing wall. The outer air/-swivel housing is secured with the body for a slip fit for ease of disassembly, cleaning and maintenance.

20 Claims, 2 Drawing Sheets

SEMI-LIQUID CEMENTITIOUS SPRAY NOZZLE APPARATUS

BACKGROUND OF THE PRESENT INVENTION

The present invention relates to a semi-liquid cementitious spray nozzle apparatus and particularly to such apparatus for pressurized application of a semi-liquid cementitious material such as cement, concrete, grout and the like to a backing or supporting surface.

In various structural applications, a vertical or other oriented wall surface is formed or covered with one or more layers of a cementitious material. For example, in-ground swimming pools may have an outer vertical wall structure lining the pool opening. The structural wall members or assembly provides an essentially continuous supporting structure for withstanding the water pressure created by the water in the pool. In one method of forming the wall, a heavy and thick cement or concrete may be applied to the earth opening to define the outer supporting wall. The cement material is for example as applied may have slump characteristics of two which upon application will be self supporting. The outer surface is then smoothed with an appropriate tool to form a smooth, final sealed surface to the pool wall. Many other structural and like applications are similarly provided with one or more finish coats of cement, grout, concrete or the like. The material is generally in a more or less semi-liquid state at the time of application, with the viscosity dependent upon application. As noted above, for forming a swimming pool, the cement is typically a slump of two. Pressurized spraying of the cementitious material provides a particularly satisfactory and cost efficient applicating system, particularly where large surface coatings are required. In such systems, a concrete pump is provided with an essentially continuous supply of the semi-liquid material with an appropriate viscosity for pumping through a hose or line. A nozzle is secured to the outermost end of the line which includes a connection 5 to a source of pressurized air. The nozzle includes suitable inlet or jet openings for introducing air pressure flow of air which discharges the material as a fan-shaped heavy spray emitted from the nozzle. The nozzle appears to act like a venturi device creating a fan-shaped discharge, which was approximately 1½" thick with a diameter of about one foot. The operator will stand about 4 feet from the wall and the flexible hose structure allows the operator to manually move the nozzle over the surface to apply and build an appropriate wall structure of the desired and appropriate height, thickness and the like.

Various spray nozzle structures are commercially available. Because of the characteristic of the material being pumped, such as the heavy concrete for a swimming pool, special considerations are required in producing a satisfactory apparatus. Generally, a tubular body member includes a hose coupling at one end for interconnection to the hose or line from the concrete pump unit. A threaded connection to the hose is generally used. In addition, the assignee of this invention has also used a quick release clamp unit having pivoted clamp arms engaging a ledge portion on the nozzle for releasably attaching of the nozzle to the end of the hose. An outer air housing is threaded onto correspondingly threaded portions of the tubular body to define an annular encircling air chamber intermediate the length of the nozzle body. A plurality of holes are distributed about the hose body within the chamber. An air connecting pipe is also secured to the outer air housing and projects outwardly at a slight angle to generally define a pistol-type nozzle structure. The air pipe is connected to a suitable air hose for pressurization of the air chamber and introduction through the openings into the nozzle body for pressurized discharge of the cement or other material. Generally, a rubber-like reducing hose end is secured to the outer end of the body to reduce the diameter of the material jet emitted from the nozzle. Systems as described have been and are available and used in the pressurized application of coating to surfaces.

The nozzle elements are preferably formed of an appropriate steel because the material being transmitted is of a more or less abrasive characteristic depending upon the particular mixture. This creates a tendency to wear the surfaces of the nozzle structure. However, steel nozzle units are relatively heavy and use for an extended period is tiring. The standard commercial steel nozzle unit generally weigh between 6 and 8 pounds. Nozzles with aluminum components are also available providing a reduction in the weight and are generally available in a range of 3 to 4 pounds. The wear characteristic of the aluminum component nozzle is significantly less than that of the steel nozzle units.

Further, in all commercial units, servicing is a relatively time consuming and tedious process. The type of material with which the nozzle is used tends to lodge, clog, and set within the various openings, joints and the like. The nozzles must therefore be disassembled and thoroughly cleaned after each use. The cleaning must be rather carefully and thoroughly done to maintain the desired operating efficiency and effectiveness of the nozzle unit. Further, the threaded structures require care in cleaning to prevent damage to the threaded portions and the like.

In the spraying process, the operator often wishes to reorient the nozzle with respect to the surface. The concrete hose is a relatively heavy, stiff member and it is of course extremely difficult if at all possible to have any significant twisting of a nozzle when threaded directly onto a threaded coupling of the hose structure. Various swivel units are therefore sold for incorporation between the nozzle and the hose structure. Such swivel units permit the desired manipulation of the nozzle. However, the swivel units add additional weight to the nozzle unit and apparatus, and further increase operator fatigue. Further, such swivel units must of course be carefully constructed to operate in the severe environment present by pumping of cement, concrete, grout and the like and also require appropriate maintenance and cleaning.

In summary, although various commercially operable and usable nozzle units for pumping of a semi-liquid cementitious type material have been known and used for many years, there has been and continues to be a request and demand for a light-weight, long-life nozzle unit with a structure which can be quickly assembled and disassembled, easily cleaned thoroughly and permits convenient swiveling and manipulation of the nozzle unit for optimum application.

SUMMARY OF THE PRESENT INVENTION

The present invention is particularly directed to a semi-liquid cementitious pumping spray nozzle unit having a special air chamber assembly with an integral swivel connection permitting the formation of a light-weight nozzle unit for optimum application of the material and further permitting very convenient and rapid cleaning of the apparatus. Generally, in accordance with the teaching of the present invention, a tubular nozzle body is formed with a standard or other desired hose coupling for a direct non-swivel connection to the pumping hose. The body is formed with a plurality of circumferentially distributed air transfer openings. An air chamber housing is coupled to the tubular nozzle body with a simple but effective slip fit defining an encircling air chamber in alignment with the transfer openings. An air hose connector, such as a pipe member, is secured to the wall of the slip fit housing and has a coupling for connection to a suitable connection to an air supply. The connector may also constitute a handle as in conventional usage for manipulation of the nozzle. The slip-fit housing provides for an automatic swivel connection of the outer air housing integrated into and forming an integral part of the air chamber. In accordance with conventional practice, a reducing nozzle end is secured to the tubular body and projects outwardly to define the desired jet of the material. The total assembly includes a simple but reliable interconnection of the various components and elements without the necessity of any threaded connections other than the standard threaded coupling of the nozzle unit to a hose end where desired. The integral and swivel unit provides the operator with the facility of optimum positioning of the nozzle unit, without increasing the weight of the nozzle unit and thus minimizes the fatigue factor. In fact, the inventor has found that the total assembly can be formed of a suitable steel material in order to establish and maintain a long operating life of the nozzle unit while significantly minimizing the weight. The nozzle unit made in accordance with the invention and constructed of steel elements for a commercial application weighed in the range of 3 to 4 pounds.

In addition, the swivel unit mount incorporated directly into the air chamber structure varies the orientation of the air inlet with respect to the air transfer openings into the central material passageway of the nozzle body. This tends to equalize the effective pressure application of the air throughout the several openings. Thus the air is applied to the air chamber at a significant pressure. Air in accordance with well known phenomonon will take the path of least resistance and generally speaking a greater air pressure is applied adjacent the orifices or adjacent the transfer openings adjacent to the pipe inlet connection or the pipe connector. Over a period of time, this has a couple of effects with respect to the air nozzle structure as such. The application of the air to the material within the central body is not truly uniform. Thus, a lesser a pressure will generally appear in the transfer openings within the body on the diametrical opposite side from the air connector. If the handle is swiveled during the operation, it will tend to distribute the air more uniformly into the material. Additionally and more significantly, the high air pressure moving through the transfer openings tends to wear the surface of the openings. Thus with time, the opening or openings aligned with the connector tend to enlarge much more rapidly than those diametrically opposite from the connector, with a corresponding gradation in the openings therebetween. The integral swivel unit tends to distribute the coupling position of the connector to the different transfer openings, thereby more fully equalizing the wear effect on the transfer openings and maintaining an essentially equalized opening size about the nozzle body. As a result, the air transfer into the material opening and thus into the material itself is maintained significantly more uniform. The spray jet is an essentially more uniform spray jet for effectively maintaining equalized application of material to the aligned surface.

The semi-liquid cement-like material is introduced into the nozzle body under a relatively high pressure from the pump unit. There is a tendency for the material to move into the transfer openings. It is of course necessary to prevent settling and lodging of the materials within the transfer openings. If the material were allowed to set in any given opening, it will form a slug which can seal that opening or at least effectively minimize the transfer of air through the opening. This could significantly disrupt the uniform characteristic of the jet of material emitted from the nozzle unit. The rotation or swiveling of the handle with the various transfer openings maintain maximum pressure transfer through the distributed openings over any normal operating period. The high pressure alignment tends to provide maximum cleaning of the transfer openings minimizing the plugging of the openings with the material. Thus, the swivel movement of the air/swivel housing effectively eliminates a stagnant area within the air chamber to maintain effective and efficient cleaning of the nozzle.

The integrated swivel and air housing assembly thus significantly increases the efficiency and effectiveness of the nozzle unit while permitting the construction of a light weight and readily clean nozzle unit.

In a particular embodiment of the present invention, a tubular steel body was formed with an integral threaded end coupling for connection to the standard threaded hose coupling. The body is formed with the circumferentially distributed air transfer openings located intermediate the length thereof. The openings are angular oriented to cause the air to move into the material opening with the air moving into and forwardly with the material. End walls for the air chamber are integrally formed with the nozzle body as by the formation of a simple exterior recess extending circumferentially about the nozzle body with the transfer openings located centrally of the recess. The end walls have peripheral recesses to receive sealing gaskets such as simple O-rings. An outer air housing in a form of a simple tubular member is telescoped over the end walls. The inner end of the housing is formed as a smooth end bearing surface. The nozzle body has a correspondingly located end annular bearing wall projecting radially outwardly and abutting the bearing surface of the housing. The opposite outer end of the air housing is also formed with a smooth flat end bearing wall surface. The housing is secured in place by a suitable retainer means.

In order to establish a smooth swivel action, a simple snap ring unit may be releasably applied to the nozzle body after assembly of the air/swivel housing. The nozzle reducer is then applied to the outer end of the nozzle in a conventional manner adjacent or abutting such lock snap washer. The nozzle reducer which is secured to the nozzle body may also be formed with an appropriate end surface directly abutting the outer smooth bearing end of the air/swivel housing. The end surface of the nozzle reducer is formed appropriately as a smooth flat surface to permit the sliding engagement of the nozzle housing.

In any system, the outer air/swivel housing can be formed as a relatively light weight metal member and with the total nozzle unit formed of a very minimal weight. It providing all of the functional advantages as described. In addition, the unit is readily assembled and disassembled for cleaning, without the problems associated with threaded couplings and the like.

The present invention thus provides a significant improvement in a nozzle unit for application of semi-liquid cementitious materials such as concrete, cement, grout and like materials, as to the initial construction, ease of use and ease and cost of maintenance.

DESCRIPTION OF THE DRAWING FIGURES

The drawings furnished herewith illustrate a preferred construction of the present invention in which the above features and others are clearly disclosed.

DESCRIPTION OF THE ILLUSTRATED EMBODIMENT

Figure 1:
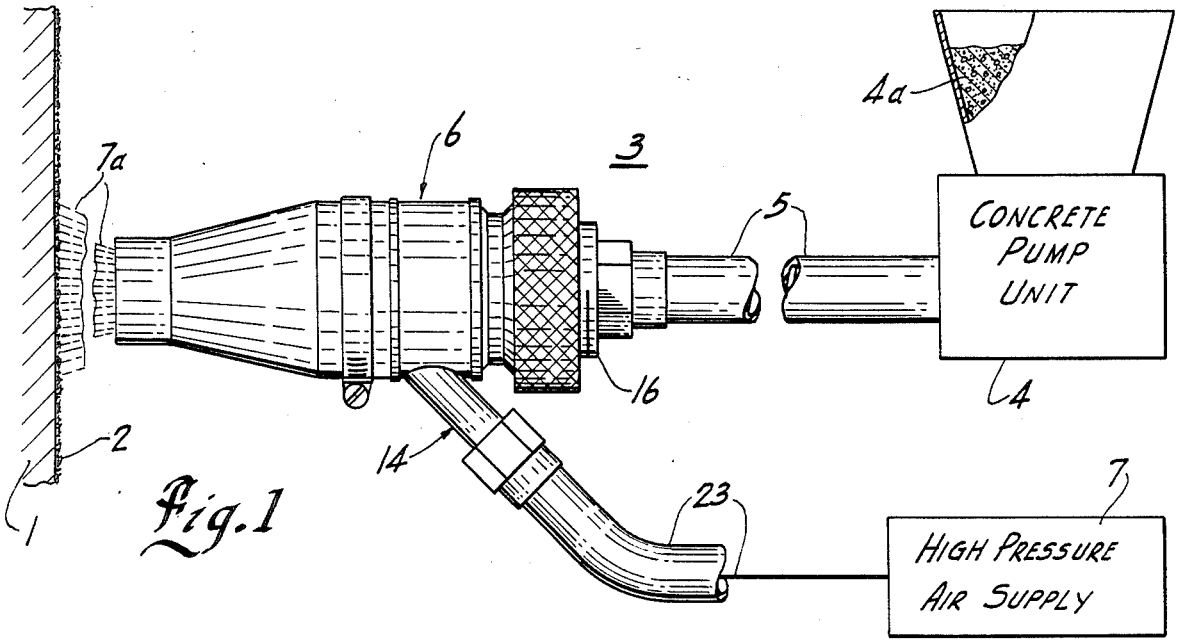
FIG. 1 is a diagramatic view of a spray coating system for application of cementitious materials with a spray nozzle unit constructed in accordance with the teaching of the present invention.

Referring to the drawings and particularly to FIG. 1, a vertical surface 1 is illustrated having a wall 2 applied thereon. The wall is typically a grout or cement formed of a mixture of concrete and/or cement, sand, water and other additives such as color and the like. In the illustrated embodiment, a cement spray applicating system 3 is illustrated. A high pressure pump source 4 is illustrated having an essentially continuous supply of the cement 4*a*. The pump unit 4 is adapted to discharge the cement 4*a* from the unit under a relatively high pressure for transfer through a line or hose 5 connected to the outlet of the pump unit 4. The hose 5 may be of a convenient length to permit the operator to move over a relatively wide area of the wall 1 for continuous application of the coating 2. A nozzle unit 6, specially constructed in accordance with the teaching of the present invention, is releasably secured to the outer most end of the hose 5. The nozzle unit 6 is coupled to a high pressure air supply 7, hereinafter described, to generate a high pressure jet 7*a* of the cement material for applying thereof as coating 2. Although shown in relatively close relation to wall 1, in practice, the nozzle may be spaced three to four feet from the surface and used to build a wall 2 having a finish thickness of 12" and three feet high. The material 7*a* may be, for example, a concrete used to build the wall of an inground swimming pool. The slump of such concrete may typically have a slump of two.

The pump unit 4, the hose 5 and the air supply 7 may be of any suitable desired or known construction for providing of appropriate pressures and movement of the concrete and the air in accordance with known technology. Consequently, no further particularized description of such components is given other than as necessary to clearly describe the structure and functioning of the nozzle unit 6 which is specially constructed in accordance with the teaching of the present invention.

Figure 2:
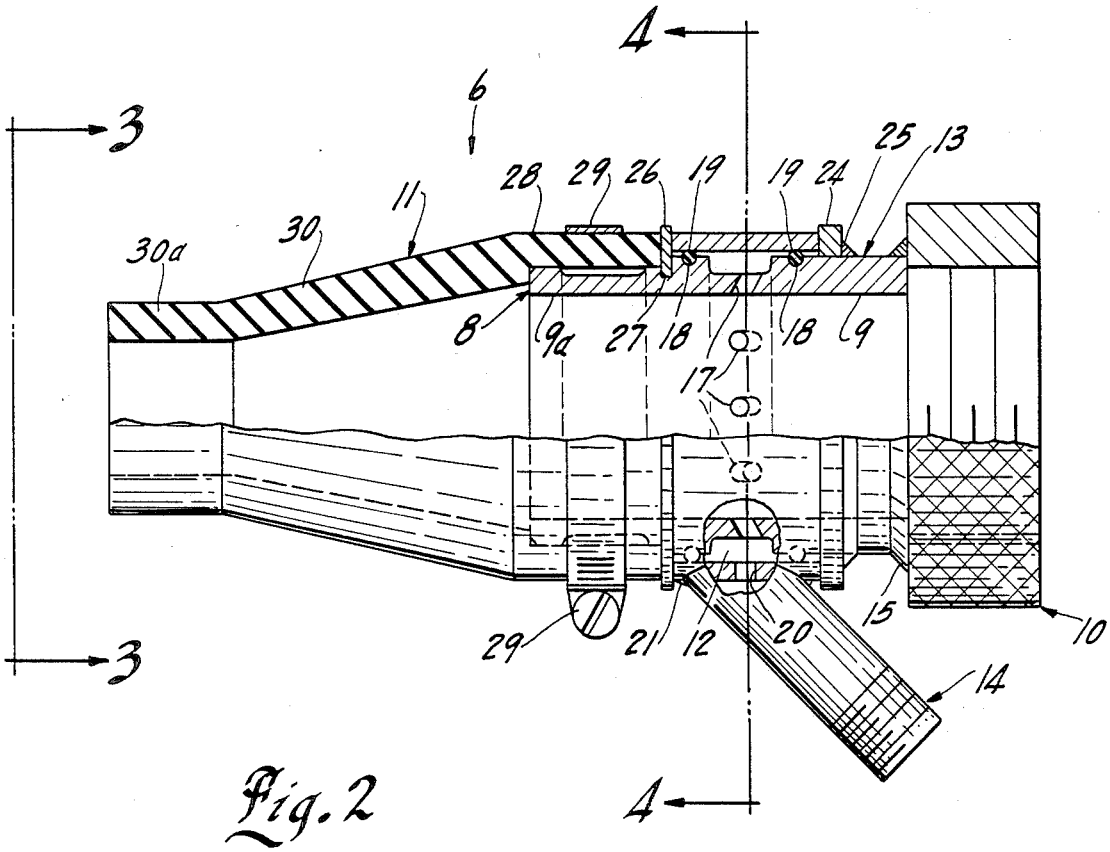
FIG. 2 is an enlarged side elevational view of a nozzle unit shown in FIG. 1 with parts broken away and sectioned to more clearly illustrate details of the illustrated embodiment of the invention.
Figure 3:
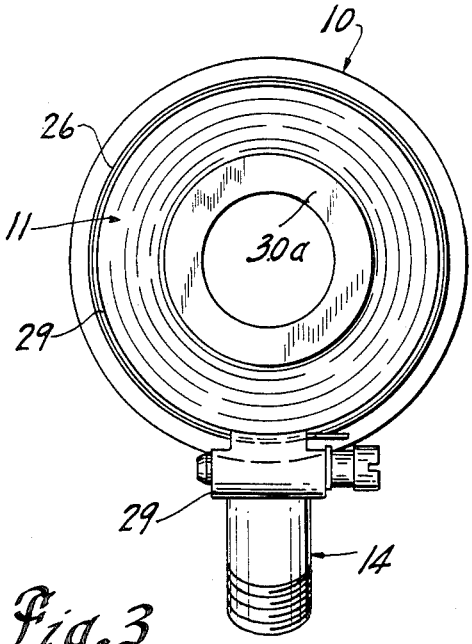
FIG. 3 is an end view of FIG. 2.
Figure 4:
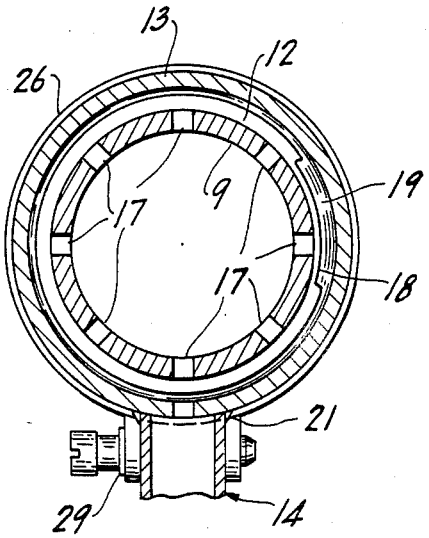
FIG. 4 is a vertical section taken generally on line 4—4 of FIG. 2.

Generally, referring to FIGS. 2 through 4, nozzle unit 6 includes a tubular nozzle body 8 having a smooth internal wall 9*a* defining a continuous passageway for the cement material 4*a* through the nozzle unit. An annular threaded pipe coupler 10 is secured to the one end of the body. A rubber nozzle reducer 11 is secured to the opposite end of the tubular body and forms a continuation thereof with a reduced cross section to reduce the diameter of the pressurized material and establish a jet 7*a* of a desired diameter. An air chamber 12 is formed by a telescoped air/swivel housing 13 located between the annular coupling 9 and the nozzle end reducer 11. The air/swivel housing 13 has a connector pipe 14 secured to the intermediate length thereof to define a pistol-type grip for manipulation of the nozzle unit. The pipe 14 is connected to air supply 7 for injecting air into the cement within the passageway of the tubular body for establishing and effecting the jet spray 7*a* of the cement material. Simultaneously with the operation of the pump unit 4, the operator manipulates the nozzle unit 6 for optimum location of the spray 7*a*. During such operation, the operator will swivel and turn the connector handle 14 about the nozzle unit as permitted by the air/swivel housing 13 to the point of the operation of the air about the nozzle unit while simultaneously providing optimum handling of the nozzle unit.

The integrated air/swivel housing incorporates a single component which as presently described establishes a light weight nozzle unit 6 which is conveniently manipulated by the operator. The assembly of nozzle unit 6 consists of parts which are readily assembled and disassembled for cleaning and maintenance.

More particularly, in the illustrated embodiment of the invention, the annular coupling 10 is an internally threaded ring member welded as by an encircling seam weld 15 to the end of the tubular body 9. The threaded coupling ring 10 is secured by turning of the nozzle body onto to a correspondingly threaded pipe end 16 of the hose 5 in accordance with well known construction. This establishes a reliable seal connection of the nozzle unit to the hose for effective transfer of the concrete from the hose into nozzle unit.

The air supply unit chamber 12 includes a plurality of equicircumferentially distributed transfer openings 17 formed in the wall of the tubular body 9 generally intermediate the length of the body. Each of the transfer opening 17 is generally similarly formed of a corresponding diameter. Each opening is angulated with respect to the direction of the material travel and in particular, extends inwardly and forwardly through the wall of the tubular body. The air is thus introduced into the internal passageway in the same direction as the cement material 4*a* flows. The high pressure mixes with and moves with the cement material outwardly of the tubular body into the nozzle reducer 11 and upon discharge from the spray 7*a*.

The air chamber 12 encircles the body 9 and as illustrated is formed as a recess. In smaller diameter nozzles, the recess has a generally rectangular cross section. In larger diameter units, the recess shape is preferably modified as hereinafter described. The periphery of the nozzle body adjacent the recess are generally smooth cylinderical surfaces having similar small annular recesses or depressions 18 of a semi-circular configuration.

O-ring seals 19 are located within the respective recesses and project outwardly slightly beyond the surfaces of the nozzle body 9.

The air swivel housing 13 is a tubular metal cylinder having a smooth inner surface. The internal diameter of the housing 13 is slightly less than the outer diameter of the assembled O-rings 19. The housing 13 is telescoped over the nozzle body 9 and particularly the O-ring seals 19 and seals the air chamber 12 as defined by the housing 13, the recess and the O-rings 19 to form an essentially closed air chamber. The connector pipe 14 is shown secured to the housing essentially aligned with the circumferentially distributed transfer openings 17. The pipe 14 projects outwardly and is welded or otherwise secured to an opening 20 in the housing as by a circumferential weld 21, to provide the air supply and provide a convenient handle for manipulating the nozzle unit. The outer end of the connector pipe 14 is threaded or otherwise appropriately formed to receive a corresponding complementing end of an air hose 23. The pipe 14 may be mounted at a slight angle or at ninety degrees to the housing 13. The user often desires to couple the concrete hose and the air hose 23 for convenient movement without interference with the operator movement. With ninety degree connection, a standard ninety degree hose coupling can attach the air hose 23 and locate hose 23 extending parallel to the concrete hose for convenient coupling as by tape or similar encircling connectors. The opposite end of the air hose is of course connected to a suitable air supply 7 for establishing a pressurized supply of continuously flowing air into and through the chamber 12 and transfer openings 17 into the cement material being pumped through the nozzle unit 6.

Those skilled in the art will readily recognize the simplicity of the assembly and disassembly of the integrated air chamber and swivel unit provided by the illustrated embodiment of the invention.

The air/swivel housing 13 is releasably locked in swivel location. In the illustrated embodiment of the invention, an inner bearing wall 24 is of a form of an annular ring welded to the tubular body 9 to the outer side of the chamber 12 by a suitable circumferential or spot weld 25. The end face of the wall is a smooth surface defining a bearing surface. The end of the air/-swivel housing 13 is formed as a smooth flat wall or edge which slideably engages the bearing surface of the annular wall 24. A bearing snap ring 26 is secured to the nozzle body 9 in outwardly spaced relation to the wall 24 essentially by the precise length of the air/swivel housing 13. The nozzle body 9 has an annular recess 27 within which the snap ring 26 of a conventional construction is releasably located. The corresponding end of the air/swivel housing 13 is formed as a flat bearing wall which bears against the snap ring for long-life, sliding engagement. The snap ring 26 provides a convenient bearing unit which is readily assembled and disassembled with respect to the nozzle unit for cleaning and maintenance. It is also a simple, inexpensive and readily replaced unit for maintaining the cost-effectiveness of the assembly.

The nozzle body 9 projects outwardly from the snap ring 26 for receiving of the nozzle reducer 11, which is a conventional construction. The nozzle reducer 11 includes a first cylindrical portion 28 having an inner diameter corresponding essentially to the outer diameter of the tubular end portion of body 9. The cylindrical portion telescopes over the end and abuts the snap ring. A conventional ring clamp 29 encircles portion 28 and secures the nozzle reducer firmly to the tubular or nozzle body. A cone shaped portion 30 narrows down to an outer tubular discharge nozzle **30*a* establishing the desired diameter of the spray jet 7*a***.

The illustrated nozzle unit 6 with the integrated air chamber and swivel unit provides a simple and relatively low cost nozzle unit of minimal weight, while permitting use of steel or other similar wear resistant material elements to maintain a desired long operating life. Thus, steel is presently the conventional wear resistant material. However, varous new materials particularly in the field of plastics are becoming available which are also highly wear resistant. The nozzle unit 6 with essentially simple slip on connections is conveniently, quickly and reliably assembled and disassembled for cleaning and maintenance.

Figure 5:
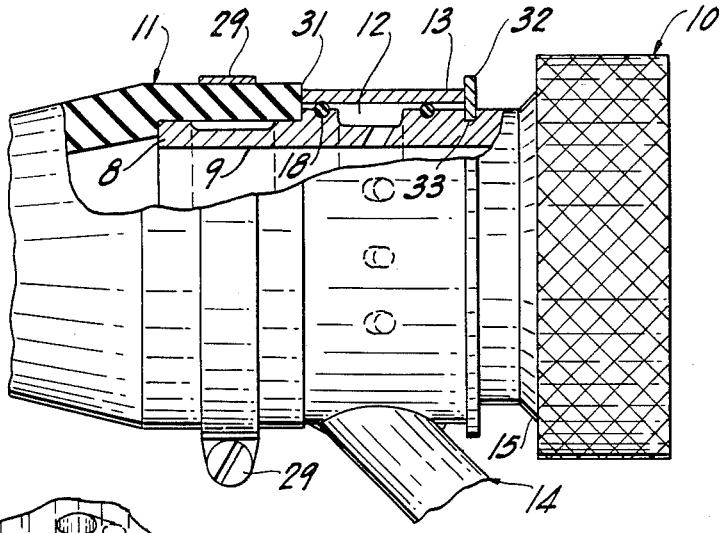
FIG. 5 is a view similar to FIG. 2 illustrating an alternate embodiment of the present invention.

The various modifications and variations in the structure can of course be incorporated into the nozzle unit. A somewhat simplified alternative structure is shown in FIG. 5. Like elements of the first embodiment and the modification shown in FIG. 5 are correspondingly numbered for simplicity of explanation and only the modification as such is described.

Referring to FIG. 5, the snap ring and the corresponding groove of the first embodiment have been eliminated. The nozzle reducer 11 has a thickness in excess of that of the air chamber 12. The nozzle end portion is clamped to the nozzle body 9 with the end face or wall 31 of reducer 11 abutting the adjacent bearing end of the air/swivel housing 13. The housing end wall is formed as a smooth, flat surface to define a sliding bearing surface. This reduces the cost and also simplifies the assembly and disassembly. The nozzle reducer 11 as previously noted is generally formed of a relatively hard rubber-like material. However, the material may not have the same bearing characteristics or life as that of a steel snap ring, and may include modification or require more frequent maintenance.

In FIG. 5, an inner bearing wall is shown as a snap ring 32 fitted in an annular groove 33 in the nozzle body 9 and spaced outwardly of O-ring seal 18 similar to wall 24 of FIG. 2. The air/swivel housing 13 is thus again mounted for swivel or rotating movement with optimum air movement and convenience handling of the nozzle.

The embodiment of FIG. 5 functions in use, service and maintenance essentially as the embodiment of FIGS. 1–4, with similar advantages of features.

Figure 6:
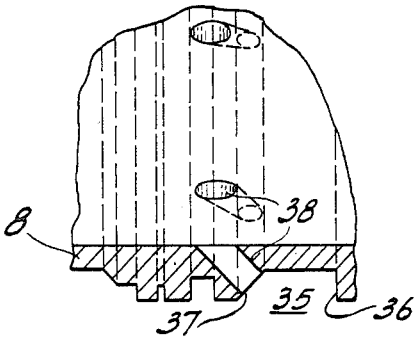
FIG. 6 is a fragmentary view showing an air chamber for larger diameter nozzle units.

FIG. 6 illustrates a modification to the forming of the air chamber in the tubular body of a nozzle unit:, which may otherwise be constructed as shown in the previous embodiments. Corresponding parts are therefore similarly numbered in FIG. 6 and only the changes are described in detail.

In FIG. 6, an air chamber 35 is formed in tubular body 8 as a specially shaped recess 36. In particular, the front wall 37 is formed with a 45 degree incline to the base of the recess. Air openings 38 for coupling of the chamber 35 to the center of body 8 are formed in the recess in the inclined wall portion of the recess 36. The air openings 38 extend through a greater body thickness and are somewhat longer than in the previous embodiment. This was found to produce an improved introduction of the air and the flow into the concrete material where the nozzle had a center opening on the order of 2½ inches. The larger nozzle requires a greater air supply, and the transfer openings are generally made larger. With the larger transfer openings, the air did not move the concrete and promote the proper flow through and from the nozzle unit. The simple modification shown in FIG. 6 produced a highly satisfactory operation with the larger nozzle units.

The above as well as other modifications and changes will be readily provided by those skilled in the art familiar with mechanical structures. For example, the air/-swivel housing may be formed as an inwardly opening U-shaped cross section with appropriate sealing means interposed between the edges of the air/swivel housing 13 and a smooth constant diameter body 9 to again establish the desired air stream.

The present invention thus provides a significantly simplified and improved nozzle unit for developing of a high pressure jet spray of an abrasive semi-liquid material for coating of a surface or the like.

Various modes of carrying out the invention are contemplated as being within the scope of the following claims and particularly pointing out and distinctly claiming the subject matter which is regarded as the invention.

I claim:

1. A semi-liquid material nozzle unit for connection to a pressurized source of a semi-liquid material such as cement, concrete, grout and other abrasive type materials and for establishing a jet spray thereof, comprising a tubular body means having a central passageway for transport of the semi-liquid material under pressure, an outer air/swivel means including an air/swivel housing coupled to said tubular body means for relative angular movement about said body means and including means developing a fluid tight coupling between said housing and said tubular body means, means for introducing of air between said housing and said tubular body means, and opening means in said tubular body means for transfer of said air into the passageway of said tubular body means.

2. The apparatus of claim 1 having an annular circumferentially extended air chamber defined by said air/-swivel housing and said tubular body means, and wherein said tubular body means includes a cylindrical portion having an outer constant diameter portion at least to the opposite sides of said annular air chamber, said air/swivel housing being a constant diameter cylindrical member and having an inner minimum diameter adapted to slide over said tubular body, and sealing means interposed between said outer diameter portion of said tubular body means and said internal diameter portions of said annular air/swivel housing to define said air chamber.

3. The apparatus of claim 1 wherein said air/swivel housing and said tubular body member are axially telescoped and slidingly connected with sealing means interposed therebetween in axially spaced relation to define an annular air chamber, said transfer openings including a plurality of circumferentially spaced openings located generally centrally of said air chamber, and a high pressure air supply connector secured to said air/swivel housing generally in alignment with said transfer openings.

4. The apparatus of claim 1 wherein said tubular body means includes a cylindrical portion having an exterior recess defining axially spaced walls of a corresponding and constant diameter, said air/swivel housing being a cylindrical member having an inner diameter slightly greater than the diameter of said spaced walls of said recess, and sealing means interposed between the exterior surface of said axially spaced walls and said cylindrical housing.

5. The nozzle unit of claim 1 having an annular circumferentially extended air chamber defined by said air/swivel housing and said tubular body means and said air/swivel housing being a constant diameter cylindrical member and having an inner minimum diameter adapted to slide over said tubular body, and sealing means interposed between said housing and said tubular body means to define said air chamber, said opening means including a plurality of circumferentially spaced openings and a high pressure inlet means connected to said housing.

6. The nozzle of claim 1 wherein said opening means includes a plurality of circumferentially spaced openings located in a common diametrical plane perpendicular to the axis of the nozzle unit, and pressure air supply pipe means secured to said air/swivel housing generally in alignment with said transfer openings.

7. The apparatus of claim 1 wherein said tubular body means includes a cylindrical portion, and said air/-swivel housing is a cylindrical member of constant diameter slidable and sealably mounted to said cylindrical portion, and bearing means secured to said body means and engaging the opposite ends of said housing to rotatably support said housing and said body means.

8. The nozzle unit of claim 1 wherein said tubular body means is a single piece tubular body having a constant internal diameter for transport of the abrasive material, said tubular body having a diameter substantially greater than the diameter of said jet spray, a hose coupler interconnected to the one end of said tubular body for sealing connection to a flexible high pressure hose for delivery of material into said tubular body, a pair of axially spaced wall members on said intermediate length of said tubular body, said spaced wall members having corresponding outer diameters, said air/-swivel housing having a cylindrical inner surface and located in telescoped sliding engagement with said wall members, means between said housing and said wall members to establish and maintain a fluid tight sealing between said axially spaced wall members and defining an air chamber therewith with said opening means therein.

9. The nozzle unit of claim 8 wherein said opening means includes transfer openings circumferentially displaced between said spaced wall members, and a high pressure air supply pipe means connected to said swivel housing in alignment with said transfer openings.

10. The nozzle unit of claim 8 including a nozzle reducer connected to said tubular body and reducing the diameter of said flowing material to a desired discharge jet diameter, said reducer abutting said air/-swivel housing to hold said housing in rotatable position to said tubular body.

11. The nozzle unit of claim 8 including a snap ring releasably securing to said tubular body and abutting said air/swivel housing to hold said housing in rotatable position to said tubular body.

12. A high pressure nozzle for developing a jet spray of a semi-liquid abrasive material, comprising a tubular body member for transport of said abrasive material and discharging of said abrasive material as a jet spray, an outer air/swivel cylindrical housing telescoped over said tubular body, a first and second sealing means interposed between said tubular body and said cylindrical housing and defining an essentially air tight seal between said tubular body and cylindrical housing, said sealing means being constructed and arranged to maintain a sliding telescoping mounting of said cylindrical housing with respect to said tubular body, releasable holding means coupled to said cylindrical housing and operable to hold said tubular housing in predetermined location to said tubular body for swivel movement on said tubular body, and air supply means coupled to said cylindrical housing for introducing air between said sealing means, and opening means for transferring of said air into said tubular body for air pressurized discharge of said abrasive material.

13. The nozzle of claim 12 wherein said tubular body is formed of a highly wear resistant material, said openings being enlarged by flow of said air through said openings.

14. The nozzle of claim 12 wherein said tubular body includes axially spaced walls, and said first periphery of said spaced walls and the inner surface of said cylindrical housing.

15. The nozzle of claim 12 wherein said cylindrical housing has first and second flat ends forming bearing surfaces, said releasable holding means includes an annular bearing wall secured to said tubular body and projects outwardly beyond the first end of said cylindrical housing, the cylindrical housing located with said first flat end in abutting sliding engagement with said bearing wall, a snap ring element releasably secured to said tubular body and located in abutting engagement with the opposite second flat end of said cylindrical housing and defining a bearing engagement therewith.

16. The nozzle of claim 15, further comprising a nozzle reducer releasably secured to said tubular body and located in abutting engagement with said snap ring.

17. A high pressure nozzle for semi-liquid abrasive material, comprising a tubular body having a passageway for transport of abrasive material, an outer air/-swivel housing for telescoped in sealing and sliding engagement with said tubular body, sealing means coupled to the housing and tubular body to define an essentially air tight seal between said tubular body and cylindrical housing, air supply means coupled to said cylindrical housing for introducing air between said sealing means, and opening means for transferring of said air into said tubular body for air pressurized movement of said abrasive material.

18. A high pressure nozzle unit for developing of a high pressure jet of an abrasive material such as concrete, cement, grout and the like, comprising a tubular body having an integral central passageway of a constant internal diameter for transport of the abrasive material and having a discharge end and an inlet end, said passageway having a diameter substantially greater than the diameter of said jet emitted from said nozzle unit, a hose coupler interconnected to said inlet end of said tubular body for sealing connection to a flexible high pressure hose for delivery of material into said tubular body, a pair of axially spaced wall members on an intermediate length of said tubular body, said spaced walls having corresponding outer diameters and having seal ring recesses, O-ring seal members located within said recesses, an outer air/swivel housing telescoped over said O-ring seals and said walls, said air/swivel housing having cylindrical inner surface and located in telescoped sliding engagement with said O-rings seals to establish and maintain a fluid tight sealing between said axially spaced walls and defining an air chamber therewith, said housing having opposite end surfaces, said tubular body having transfer openings circumferentially displaced about the body and extending between said air chamber and the center passageway of said body, a high pressure air supply pipe member connected to said swivel housing in alignment with an opening into said air chamber, said air supply pipe constituting a handle for manipulation of said nozzle apparatus, a nozzle reducer coupled to said tubular body and reducing the diameter of said flowing material to a desired discharge jet diameter, and means coupled to said tubular body and abutting said opposite end surfaces of said air/-swivel housing to hold said housing in rotatable position to said tubular body.

19. A high pressure nozzle for pressurized discharge of a semi-liquid material, comprising a tubular body member having a passageway for transport of the material, an outer air/swivel housing telescoped in sealing and sliding engagement with said tubular body, a fluid transfer chamber formed in the exterior of said tubular body and having an inclined front wall establishing a large opening into said chamber, sealing means coupled to the housing and tubular body to define an essentially fluid tight seal between said tubular body and housing about said chamber, fluid supply means coupled to said housing for introducing fluid into said chamber, and a plurality of openings in said inclined front wall said each opening having a depth substantially equal to the length of said inclined front wall for transferring of said fluid into said tubular body for pressurized movement of said material.

20. The nozzle of claim 19 wherein said front wall includes an angle of substantially forty-five degrees, and said opening means being straight openings substantially to said front wall.

* * * * *